US007352118B2

(12) United States Patent
Chowdhury et al.

(10) Patent No.: US 7,352,118 B2
(45) Date of Patent: Apr. 1, 2008

(54) OPTIMIZED ULTRAVIOLET REFLECTING MULTI-LAYER COATING FOR ENERGY EFFICIENT LAMPS

(75) Inventors: Ashfaqul I. Chowdhury, Mayfield Heights, OH (US); Rajasingh Israel, Westlake, OH (US); Gary R. Allen, Chesterland, OH (US)

(73) Assignee: General Electric Company, Schenectady, NY (US)

( * ) Notice: Subject to any disclaimer, the term of this patent is extended or adjusted under 35 U.S.C. 154(b) by 375 days.

(21) Appl. No.: 10/732,885

(22) Filed: Dec. 10, 2003

(65) Prior Publication Data

US 2005/0127840 A1 Jun. 16, 2005

(51) Int. Cl.
*H01J 61/35* (2006.01)
*H01J 5/16* (2006.01)

(52) U.S. Cl. ..... 313/112; 313/110; 313/113; 313/489; 313/635; 362/61; 362/150; 356/121

(58) Field of Classification Search ..... None
See application file for complete search history.

(56) References Cited

U.S. PATENT DOCUMENTS 4,663,557 A 5/1987 Martin, Jr. et al.
4,868,458 A 9/1989 Davenport et al.
4,958,263 A 9/1990 Davenport et al.
5,017,839 A * 5/1991 Arlt et al. ..... 315/219
5,032,762 A 7/1991 Spacil et al.
5,059,865 A * 10/1991 Bergman et al. ..... 315/82
5,138,219 A * 8/1992 Krisl et al. ..... 313/112
5,140,457 A 8/1992 Letter
5,196,759 A 3/1993 Parham et al.
5,214,345 A * 5/1993 Saito et al. ..... 313/112
5,540,978 A * 7/1996 Schrenk ..... 428/212
5,552,671 A 9/1996 Parham et al.
5,587,626 A * 12/1996 Parham et al. ..... 313/634
5,646,472 A * 7/1997 Horikoshi ..... 313/112
5,666,017 A * 9/1997 McGuire ..... 313/110

(Continued)

FOREIGN PATENT DOCUMENTS

EP 04082101 7/1990

(Continued)

*Primary Examiner*—Sikha Roy
(74) *Attorney, Agent, or Firm*—Fay Sharpe LLP

(57) ABSTRACT

A metal halide lamp (10) includes a light-transmissive envelope (12) which encloses a metal halide pool (30) for generating a discharge when spaced apart electrodes (20, 22) within the envelope are supplied with an electric current. A multi-layer coating (40) is deposited on a surface (42) of the envelope. The coating includes several layers of at least two materials of different refractive index, which, in combination, reflect radiation in the UV region of the electromagnetic spectrum. Rather than optimizing the coating for a normal (i.e., 0°) angle of incidence on the coating, the multi-layer coating is optimized at an angle which is selected to be within 10° of the mean angle ($\alpha$) of incidence of the UV radiation on the arctube surface, thereby increasing the amount of UV radiation which is returned to the metal halide pool. The coating is preferably optimized for high reflectivity in the UV-region of the spectrum and high transmission in the visible region of the spectrum to maximize useful light output while reflecting UV light back to the metal halide pool for improved heating of the pool.

24 Claims, 5 Drawing Sheets

U.S. PATENT DOCUMENTS

| | | | | |
|---|---|---|---|---|
| 5,866,983 | A | 2/1999 | Prochazka et al. | |
| 5,898,273 | A | 4/1999 | Collins et al. | |
| 5,909,082 | A | 6/1999 | Speaker | |
| 5,952,768 | A * | 9/1999 | Strok et al. | 313/110 |
| 5,952,784 | A | 9/1999 | Witting | |
| 6,611,082 | B1 * | 8/2003 | McGuire | 313/110 |
| 6,967,443 | B2 * | 11/2005 | Bigio et al. | 313/635 |
| 7,221,374 | B2 * | 5/2007 | Dixon | 345/591 |

FOREIGN PATENT DOCUMENTS

| | | |
|---|---|---|
| EP | 00565703 | 10/1992 |
| EP | 00890556 | 12/1999 |

* cited by examiner

OPTIMIZED ULTRAVIOLET REFLECTING MULTI-LAYER COATING FOR ENERGY EFFICIENT LAMPS

BACKGROUND OF THE INVENTION

1. Field of the Invention

This invention relates to optical interference coatings for lamps and finds particular application in conjunction with a multi-layer ultraviolet (UV) reflecting coating for an arctube of a metal halide lamp which reflects UV radiation into the metal halide pool for increased efficiency of the lamp.

2. Discussion of the Art

Metal halide lamps use a fill comprising a metal halide, mercury, and a rare gas. The metal halides, which often comprise sodium iodide and scandium iodide, are partially vaporized from the molten liquid pool during lamp operation. When the lamp is energized, an arc discharge is created, which emits radiation at wavelengths above about 200 nm. Radiation emitted between 100-400 nm is ultraviolet (UV) radiation, which is harmful to human eyes and skin and which also causes fading, discoloration and degradation of fabrics, plastics, and paints. In addition to the harmful effects of UV radiation which escapes a lamp, the UV radiation is essentially wasted, since it does not contribute to useful, visible illumination.

In a typical operating quartz metal halide (QMH) lamp, the molten metal halide pool absorbs at least 50% of the incident radiation below 450 nm, and at least 80% of that below 400 nm. In vertical operation of a cylindrically shaped arctube, the molten metal halide pool may cover the lower 25% of the inside surface of the arctube. As the temperature of the metal halide pool is increased, the vapor pressure of the metal halide gas is increased, and the relative contribution of the metal halide to the fill is enhanced, relative to the contribution from the mercury. This imparts the metal halide lamp with higher efficacy and better color, relative to a high-pressure mercury lamp.

In some QMH lamps, a heat-conserving endcoat, often comprising alumina, is applied to the outside surface of the arctube over the area corresponding to the metal halide pool in order to operate the metal halide pool at a higher temperature. In some vertically-burning QMH designs, the lower end of the arctube is made with a smaller diameter than the upper end to heat the metal halide pool more efficiently, without overheating the upper end of the arctube.

Several methods have been employed to block the emission of the harmful UV. Traditional metal halide lamps employ an arctube of generally pure quartz enclosed in a glass outer jacket to provide UV protection. Newer metal halide products, however, such as fiber optic sources (see, for example, U.S. Pat. No. 4,958,263) and automotive lamps (see, for example, U.S. Pat. No. 4,868,458), encounter size and use constraints which limit the use of glass outer jackets. Arctubes made from doped quartz (see, for example, U.S. Pat. No. 5,196,759) have been used to absorb the UV emissions from the arc within the arctube itself, thus eliminating the need for a glass outer jacket. However, the UV-absorbing dopants in doped quartz cause enhanced devitrification and shortened lamp life. Naturally occurring "hot spots" within the arctube wall are formed directly above the discharge in metal halide arctubes due to natural convection of the gases inside the arctube. Absorption of UV radiation by a doped quartz arctube tends to worsen further the hot spots on the arctube wall. The greater susceptibility of doped quartz to devitrification and softening, aggravated by the additional overheating at the hot spot due to absorption of UV by the doped quartz, can result in rapid failure of the lamp. For this reason, it is common to restrict the use of doped quartz to shrouds or jackets surrounding the arctube, rather than using it for the arctube, itself.

A further option for UV protection is the use of coatings on the outer surface of the arctube. U.S. Pat. No. 5,336,969 describes the use of a coating comprising a suspension of $CeF_3$ and $Al_2O_3.SiO_2$, which is applied to the arctube surface and fired. This coating operates to absorb UV radiation. U.S. Pat. No. 4,949,005 discloses a tantala-silica interference filter used on a tungsten halogen lamp to reflect or absorb specific wavelengths by variation in filter design. IR heat radiation is preferentially reflected back to a tungsten filament to improve the efficacy of the halogen lamp. U.S. Pat. No. 5,552,671 discloses a UV reflecting multi-layer coating for use on a metal halide arctube, which absorbs deep UV and reflects near UV radiation. The reflective nature of the coating allows UV radiation to bounce off the coating and be absorbed by the metal halide pool. This allows attenuation of the UV emission from the arctube, without the use of doped quartz with its attendant overheating of the quartz hot spots, in order to increase the life of the arctube.

The present invention provides an optimized UV reflecting multi-layer coating and method of preparation, which overcome the above-referenced problems and others.

BRIEF SUMMARY OF THE INVENTION

In an exemplary embodiment of the present invention, a method of improving the efficacy of a metal halide lamp is provided. The method includes disposing a multilayer coating on a surface of an arctube. The coating includes layers of at least two materials of different refractive index, which in combination reflect radiation in the UV region of the electromagnetic spectrum. The coating is optimized to reflect at least 95% of UV radiation striking the coating. The method further includes operating the lamp to cause UV emission from an arc and reflecting the UV radiation back into the lamp.

In another exemplary embodiment of the present invention, a method for improving the efficiency of a metal halide lamp is provided. The method includes determining a spectral power distribution for the lamp and disposing a multilayer coating on a surface of an arctube of the lamp which reflects radiation in the UV region of the electromagnetic spectrum. The coating is optimized to reflect UV light at each of a plurality of wavelengths in direct proportion to the spectral power at each of the plurality of wavelengths. The lamp is operated to cause UV emission from an arc and the UV radiation reflected back into the lamp.

In another exemplary embodiment, a method of improving the efficacy of a metal halide lamp is provided. The method includes disposing a multi-layer coating on a surface of an arctube. The coating includes layers of at least two materials of different refractive index, which in combination reflect radiation in the UV region of the electromagnetic spectrum. The multi-layer coating is optimized at an angle which is selected to take into account off-normal incidence of the radiation on the arctube during operation of the lamp. The lamp is operated to cause UV emission from an arc and the UV radiation reflected back into the lamp.

In another exemplary embodiment, a metal halide lamp is provided. The lamp includes an envelope. A metal halide pool is disposed within the envelope for generating a discharge when the lamp is operated. A multi-layer coating on a surface of the envelope includes layers of at least two materials of different refractive index, which in combination reflect radiation in the UV region of the electromagnetic spectrum. The multi-layer coating is optimized for at least one of a) reflection of UV radiation which strikes the envelope at an angle which is within 10° of a mean angle of incidence of the UV radiation on the arctube, b) reflection of at least 95% of UV radiation striking the coating, and c) reflection of UV light at each of a plurality of wavelengths in direct proportion to the spectral power at each of the plurality of wavelengths.

One advantage of at least some embodiments of the present invention is to relieve a lamp arctube of the effects of hot spots, and to improve the spatial uniformity of the arctube temperature.

Another advantage of at least some embodiments of the present invention is an increase in the temperature of the metal halide pool, resulting in greater metal halide lamp efficiency and color rendering.

Still further advantages of the present invention will become apparent to those of ordinary skill in the art upon reading and understanding the following detailed description of the preferred embodiments.

DETAILED DESCRIPTION OF THE INVENTION

Figure 1:
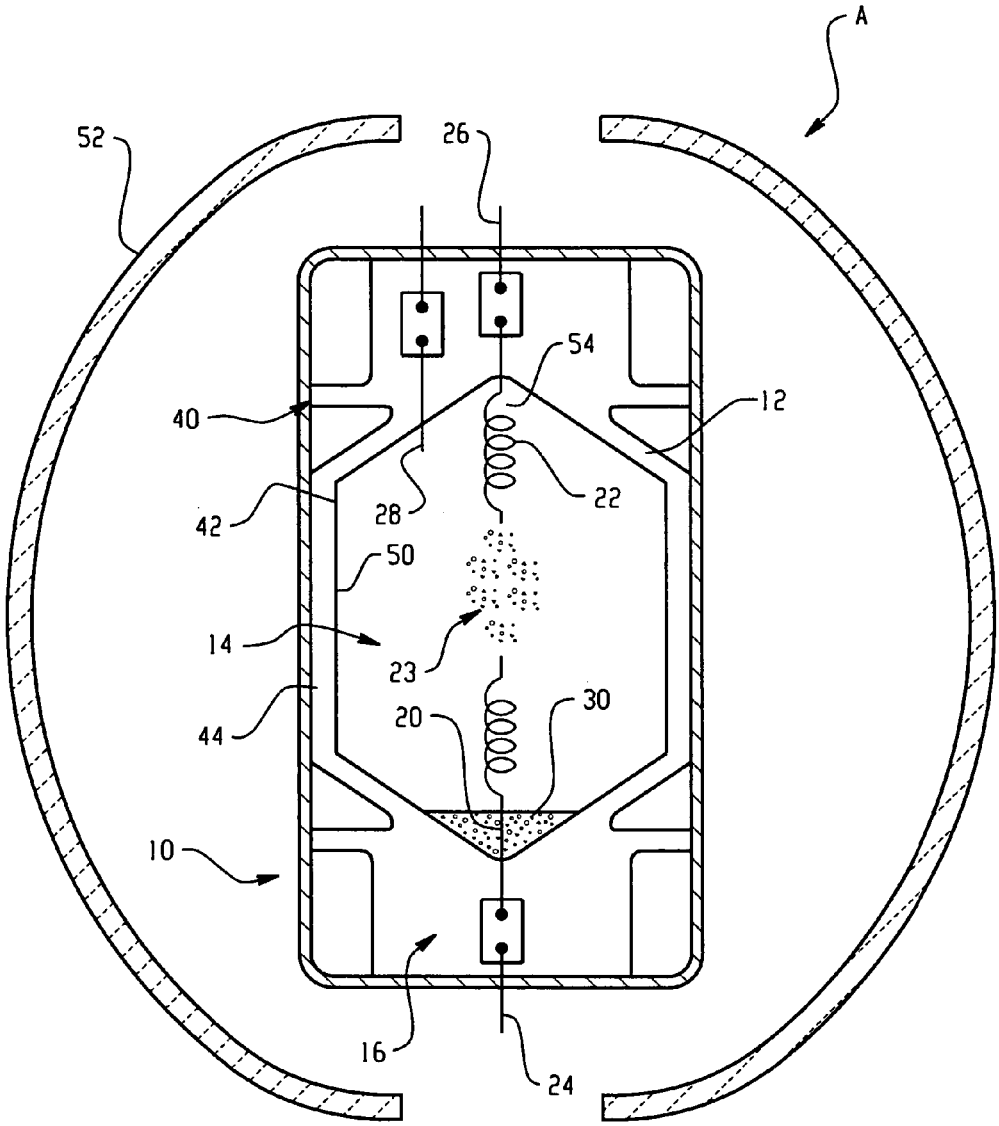
FIG. 1 is a cross-sectional view of a lamp according to the present invention.

A multi-layer coating composition is intended for use on metal halide lamp surfaces. The coating reflects UV radiation from the arc and helps to increase the vapor pressure of the metal halides. Specifically, a UV reflective coating is formed on a surface of the arctube of a metal halide lamp. The coating is optimized at an off-normal angle, to achieve substantial (10-15% or more) gains in efficacy as compared to uncoated lamps. Preferably, the coating is optimized for high reflectivity (hi-R), over a preferred range of wavelengths.

The term "metal halide lamp," as used herein, refers to all metal halide lamps, such as automotive headlamps, display lighting and lamps, generally lighting and lamps, and fiber optic sources, and the like. The UV reflective coating freely transmits light in the visible portion of the spectrum, from about 400 to about 700 nm, and reflects light in the UV portion of the spectrum, from about 300 to about 400 nm. The coating comprises multiple layers of high-temperature resistant materials, such as the oxides of silicon, tantalum, and titanium. The lamp contains a fill which may contain mercury in addition to a halide. The emitted light from the lamp includes UV radiation.

By "UV radiation" is meant radiation having a wavelength generally in the range of 100-400 nm. Wavelengths in the 400-700 nm range are considered to be in the visible range. UV radiation degrades various dyes, colors and pigments found in fabrics and materials, such as the materials present in displays, in addition to being injurious to humans. The present multi-layer coating preferably blocks UV radiation having a wavelength between about 300 and 400 nm and may also block radiation in the 200-300 nm range and, at the same time, is substantially non-absorbent and transparent to visible light radiation.

The multi-layer coating is designed to reflect a certain portion of the UV radiation emitted by the arc back into the arctube and preferably also some of the visible rays. Upon reflection back into the arctube, the reflected UV radiation causes further vaporization of the liquid metal halide dose within the arctube, thereby enhancing lamp performance. In order to maximize the heating of the metal halide pool by the captured UV, it is desirable that the UV coating have good reflectivity up to 400 nm, and possibly even at somewhat longer wavelengths than 400 nm. However, reflection by the coating of wavelengths significantly longer than 400 nm, and especially longer than 420 nm will have the effect of blocking desirable visible radiation, and reducing the efficacy of the lamp. There is a trade off between loss of lumen output and benefits gained by heating the metal halide pool if the coating reflects wavelengths greater than 400 nm. Thus, it is desirable to reflect at least a controlled portion of the wavelengths up to about 420 nm or even up to about 450 nm back into the arctube, in addition to reflecting the UV. Wavelengths above about 400 nm, in the 400-450 nm range, are considered to be in the visible range.

This invention is particularly well suited for those lamp applications which require the use of pure quartz, or undoped quartz, due to high operating temperatures. Doped quartz has lower viscosity than pure or undoped quartz, due to the dopants, making it undesirable for high temperature applications. Further, in those applications, such as automobile and beam forming uses where it is desirable to avoid scattering or reflection of the visible light, there is a benefit from the use of arctubes having no dopants or exterior elements which may interfere with light transmission.

FIG. 1 illustrates an exemplary metal halide lamp A. The lamp includes a burner 10 comprising an arctube 12, formed from a light-transmissive material, such as quartz, glass, ceramic, or high temperature plastic. The invention is particularly suited to metal halide (MH) lamps in which the arctube is formed from transparent quartz or clear transparent ceramic. It is also applicable to translucent ceramic metal halide lamps. The arctube is in the general shape of a cylinder, sphere or ellipsoid, which defines an internal chamber 14. The arctube 12 may be arranged vertically, as shown in FIG. 1, or horizontally. By "vertically aligned," it is meant that the longest dimension of the lamp is aligned generally vertically during operation. By "horizontally aligned," it is meant that the longest dimension of the lamp is aligned generally horizontally during operation. The arctube is hermetically sealed at 16 by means of a customary pinch seal or shrink seal. Optionally, spaced apart electrodes 20, 22, formed for example, from tungsten, extend into the chamber and carry a current from an outside source of power (not shown) for creating an arc discharge 23 within the chamber. Leads 24, 26 connect the electrodes with the source of power. A starter electrode 28 may be used for initiating the discharge, although electrodeless lamps are also contemplated.

When a voltage is applied across the electrodes and the lamp is caused to operate, a vaporizable material 30, such as a pool of metal halide and mercury, at the base of the chamber vaporizes in the discharge, creating radiation in both the visible and UV regions of the electromagnetic spectrum.

The multi-layer optical interference coating 40 is formed on an exterior surface 42 of the walls 44 of the arctube 12. The multi-layer coating 40 is optimized for reflecting harmful UV back into the chamber, while permitting useful light in the visible region to pass through the arctube wall.

In conventional QMH lamps, the temperature of the metal halide pool has been found to be far below that desirable for peak efficacy and highest color quality. By the addition of the UV-trapping thin film coating 40, the metal halide pool is advantageously and significantly heated by the trapped UV which would otherwise be uselessly radiated out of the arctube. The heating of the metal halide pool by the coating 40 is effective to allow a coated QMH lamp, with or without an alumina endcoat, to operate at higher efficacy than a conventional uncoated QMH lamp having an alumina endcoat.

Lamps for which the coating 40 is particularly well suited include metal halide lamps, as defined hereinabove. The coating 40 substantially eliminates UV radiation, thereby reducing the tendency of display lamps to cause fading of displayed items, such as fabric, plastics, or painted articles. Further, the coating functions to protect the lamp casing and surrounding parts, which may be made of a plastic, susceptible to UV degradation, and to prevent fiber optic degradation. The lamp may be prepared without an alumina endcoat on the arctube, which is traditionally used to help heat the metal halide pool.

The coating 40 has a multi-layer arrangement wherein various (usually alternating) coating layers comprise materials of differing (i.e., high and low) refractive indices. The preferred choice of coating materials is based on high-temperature capability, low absorption in the visible and infrared wavelength ranges where the lamp radiation is strong, and the durability and ease of deposition of the materials. The layer thicknesses are selected to optimize the reflectivity in about the 300 to 400 nm range of UV wavelengths, while preserving the transmission in about the 400 to 700 nm range of visible wavelengths. By reflecting, rather than absorbing the UV light, the coated arctube acts as a UV bottle, trapping the UV which bounces around inside the arctube chamber until it strikes, and is absorbed in, the metal halide pool. In one embodiment, the combination of alternating low and high refractive index materials is selected to cause reflection of UV radiation in the 300-400 nm range and reflection of some visible radiation in the 400 to about 420 nm range. The coating thus provides a series of quarter wavelength reflectors, reflecting light below about 400 nm.

Coatings 40 in keeping with the subject invention have a thickness of from about 0.2 to 4.0 microns, with 2 to 100 or more layers. Individual layers within the coating may have thicknesses which range from 10 nm to 250 nm. These ranges are a function of the reflective characteristics of the individual coating materials and will therefore change with a particular coating configuration. Any number of layers may be used, although at least several pairs of layers are used to achieve significant reflectivity. Cost, optical transparency, and strength of the coating may limit the number of layers and overall thickness. For convenience of fabrication, about 10-50 layers may be used to advantageously increase the lamp efficacy.

The multi-layer coating 40 may be deposited by any suitable deposition technique known for depositing coating materials on arctube surfaces. Exemplary techniques include, but are not limited to chemical vapor deposition, thermal evaporation, plasma-assisted chemical vapor deposition, ion plating, dip coating, ion beam deposition, sputtering, and laser ablation.

The multi-layer coating 40 preferably comprises at least one of the oxides or nitrides of aluminum, tantalum, titanium, silicon, niobium, hafnium, cerium, zirconium, yttrium, erbium, europium, gadolinium, indium, magnesium, bismuth, thorium, and combinations thereof and similarly suitable rare earth metals. More preferably, it comprises a combination of at least two of the above oxides or nitrides. In one preferred combination, a silica component, in combination with one of the other high refractive index oxides or nitrides, contributes to the reflective quality of the coating.

In combination, the foregoing materials result in a coating which effectively transmits visible light radiation in the about 400-700 nm portion of the spectrum, and reflects UV light radiation in the about 300-400 nm portion of the spectrum, and reflects some visible radiation up to about 420 nm.

There are a large number of computer programs commercially available for optimizing multi-layer coatings (computer optimization). These computer programs, include Optilayer (Optilayer, Ltd., distributed by DeBell Design); TF Calc (Software Spectra, Inc.); and McLeod Professional (published by the Thin Films Center in Phoenix, Ariz.). The program is fed with the desired characteristics of the coating, e.g., the desired reflectivity/transmittance at each wavelength or wavelength range in the spectrum, the desired angle of incidence of the light upon the coating, the total or maximum number of layers, and a weighting factor, which prescribes the relative importance of each of the desired characteristics. Such programs are capable of dividing the electromagnetic spectrum into a large number of wavelength ranges, and analyzing each one separately. The program then determines the optimum number and thickness of each of the layers for optimizing the coating to meet the selected parameters. It does this by determining an arrangement of layers and checking the arrangement against the selected parameters. The program then makes minor modifications to the arrangement, such as by changing the thickness of one or more layers, and the checks the new arrangement to see if the arrangement is better or worse in terms of optimizing the selected parameters. The process is repeated until no further improvements can be made. Obviously, not all the parameters can be optimized fully at the same time, but those parameters which are assigned a greater weighting receive a higher priority in the optimization.

Figure 2:
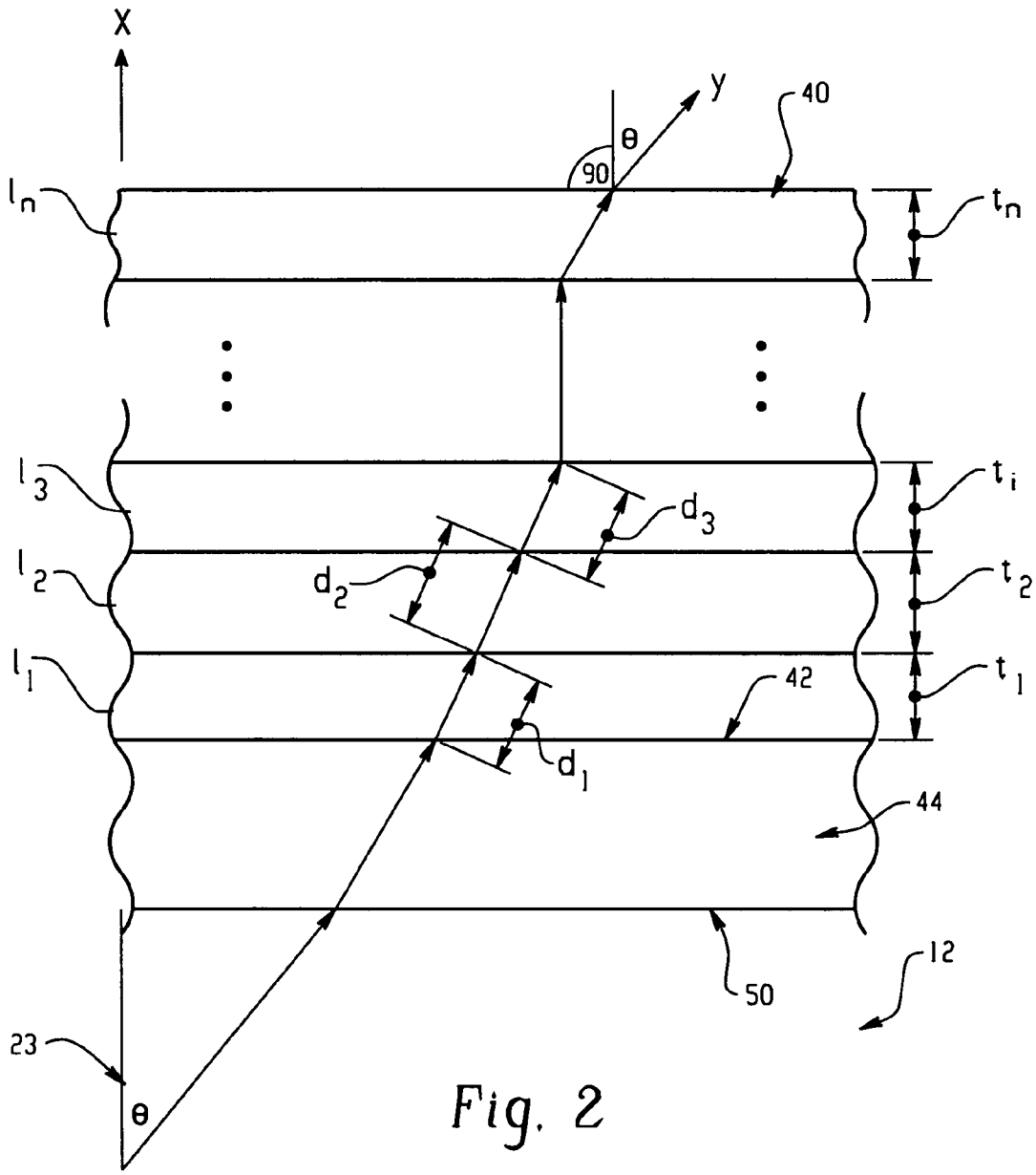
FIG. 2 is an enlarged sectional view of the arctube wall of FIG. 1, showing the path of the UV rays.

In the past, such programs have been used to generate multi-layer coating designs for capturing radiation in the UV or IR range of the electromagnetic spectrum. However, the coatings as previously designed were all set to calculate the thickness of the coating layers at an angle θ which is generally normal, or close to normal, to the inner surface 50 of the wall 44 of the arctube adjacent the discharge (FIG. 2). The thicknesses $t_1, t_2, \ldots t_n$ (for a coating with n layers), of each of the layers $l_1, l_2, \ldots l_n$, in the multi-layer coating were calculated based on the assumption that the light emitted travels in direction x, a distance $t_i$ through each layer (where i is 1, 2, . . . n). The index of refraction in each layer l is $n_i$.

From ray tracing calculations, the present inventors have found, however, that the angle at which light strikes the inner surface 50 of the arctube wall is not primarily at an angle which is normal to the surface. Rather, because of the finite diameter of the arc and the extended length of the arctube, and the multiple bounces within the chamber, the light strikes the wall 44 over a range of angles θ which has a mean at an angle α, which is "off normal," generally from about 5-35° from normal (direction x). (See FIG. 3). The rays strike the wall over a range of angles, thus α represents a mean angle at which the photons in the UV range arrive at the arctube wall. Clearly, if the coating is placed on the inner surface 50 of the arctube, the surface at which α is measured is the innermost surface of the first layer of the coating.

Figure 3:
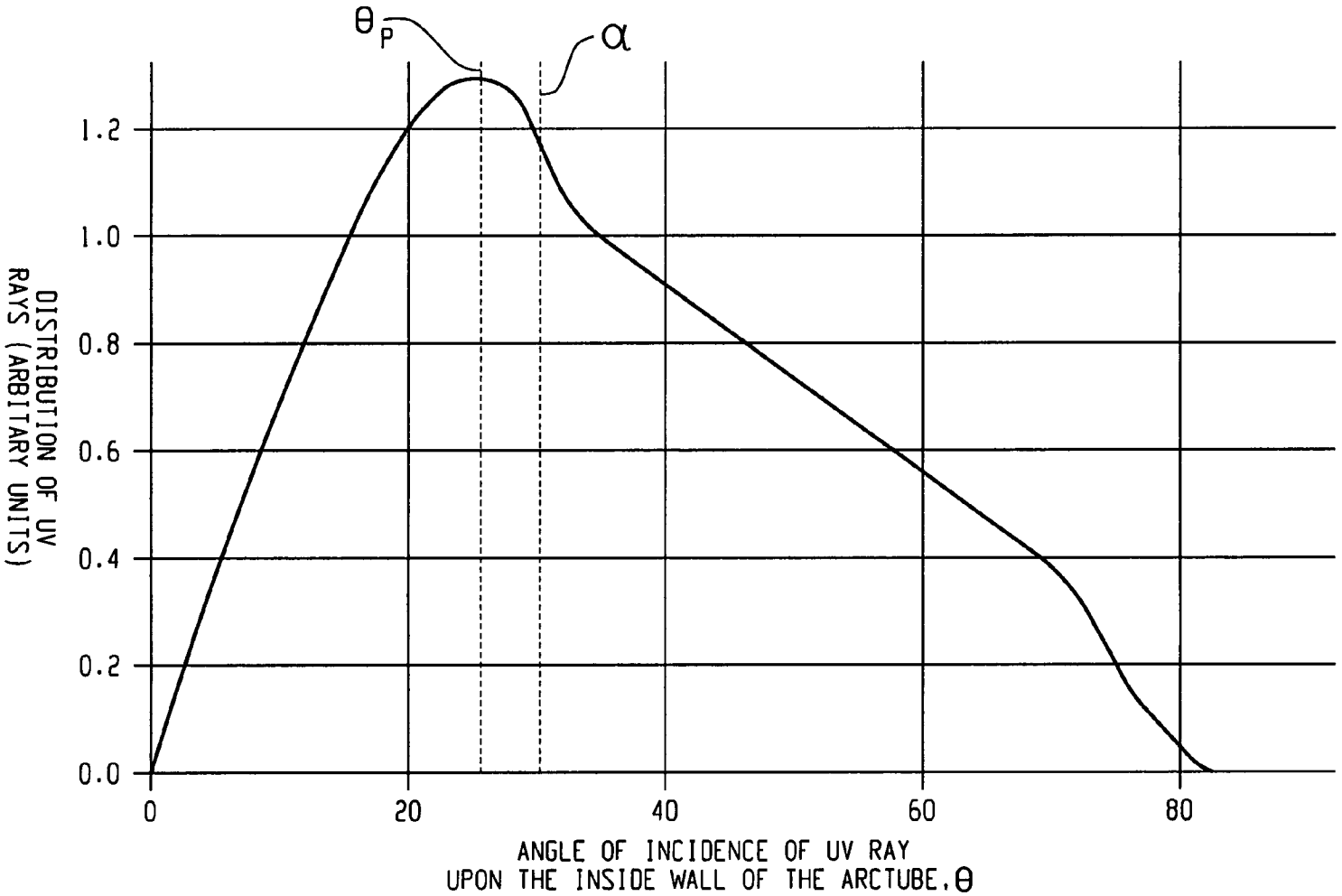
FIG. 3 is a schematic plot of number of photons versus angle of incidence$\theta$.

Note that, as shown in FIG. 3, α is not necessarily at the peak or predominant angle of incidence $\theta_P$, but, because the curve is skewed somewhat to higher angles, α is generally slightly greater, typically about 5-7° greater than $\theta_P$. The angle α depends on the radial and angular distribution of light emission from the arc and on the shape and dimensions of the arctube. Because the UV predominantly strikes the wall at an angle α, the UV light travels through layers $l_i$ a distance $d_{i1}$ which is greater than $t_i$, since $d_i=t_i/(\cos \alpha/n_i)$.

Thus, in conventional coating designs, the thicknesses of each of the layers are not optimized for the distance actually traveled when the light strikes at an off-normal angle.

In a preferred embodiment, the program used to calculate the number and thickness of the layers is optimized at an angle which is α or close to α. Preferably, the program is optimized, at an optimization angle which is within ±10° of α, more preferably, within ±5° of α, more preferably, within ±2° of α, and most preferably, at angle α.

By optimizing the layer thicknesses for the off-normal angle α rather than for normal angle of incidence, improvements in UV reflection by the coating and in light output of the lamp have been found.

Ray tracing models are preferably used to determine the radial and angular distribution of UV rays undergoing several reflections inside an arctube. For a cylindrical quartz metal halide lamp of the type shown in FIG. 1, one ray tracing model showed that the UV rays have an angular distribution pattern which peaks in the 20-40° range, and has an angle α of about 30°.

In a vertically oriented lamp, as shown in FIG. 1, a 10-20% or more increase in reflection of the distribution of UV light may be obtained by optimizing at, or in the region of the angle α as compared with a lamp optimized at 0° from normal. For example, where θ was found to peak ($\theta_P$) at about 260° from normal and α was found to be about 30° (FIG. 3), the film was optimized for about 30° from normal, rather than for a normal angle (0°) Over long term use, a 30% improvement in maintained lumens may be achieved.

For cylindrical, vertically oriented lamps of the same general configuration as shown in FIG. 1, the mean incident angle α is found to be predominantly in the 15-40° range, more commonly in the range of 25-35°. Thus, the coating design may be conveniently carried out at an optimization angle within the 15-35° range, more preferably, from about 25° to about 30°, without the need for evaluating the exact angle α of mean incidence. More preferably, however, the angle α is determined for the particular lamp design to be coated either experimentally, or empirically, using a ray tracing calculation and the coating design optimized for, or close to, this angle. Beyond about a 30-35° optimized angle, however, the coating may block some of the visible output, offsetting some of the benefits of optimization. Thus, it is preferable to optimize at about 30° from normal or below.

For shaped (non-cylindrical) vertically oriented arctubes, i.e., those with a bulge in the region of the discharge, the mean angle α is generally lower than for an equivalent cylindrical lamp, and may be closer to 20°. Thus, the coating design is preferably optimized at or about 20°.

For horizontally aligned tubes, the optimized angle is generally lower still, close to normal (0-15%). An increase in lumen output of about 10% or more is readily achieved for horizontal lamps by selecting an appropriate angle which is within about ±5° of α, more preferably, at α.

While the coating 40 is shown as deposited on the outer surface of the arctube wall 44, it is also contemplated that the coating may be alternatively formed on an inner surface 50, of the wall. The coating preferably covers the entire surface of the wall so that all UV radiation exiting the lamp is incident on the coating, although the coating could, alternatively, be confined to an area where the UV is predominantly emitted.

The multi-layer coating 40 may be combined with an infrared filter, if desired. The arctube may be surrounded by a light-transmissive shroud or outer jacket 52. The lamp may also include a reflector (not shown).

The number of layers and thicknesses of each of the layers in the coating 40 are preferably optimized to reflect UV of a particular wavelength or wavelengths corresponding to those emitted by the discharge, and which are subsequently absorbed by the molten metal halide pool.

For a quartz metal halide lamp, comprising a fill of mercury (Hg), sodium (Na) and scandium (Sc), UV peaks are typically found at 365 (Hg), 391 (Sc) and 405 (Hg) nm. Table 1 shows the Spectral Power Distribution of an uncoated QMH lamp. The power radiated by the arc increases with increasing wavelength through the UV range, and even into the violet range in the visible. In general, the higher the cutoff wavelength of the UV-reflecting coating design, the greater amount of radiated power will be captured by the coating and the greater will be the heating of the metal halide pool. It is therefore desirable to optimize the film to reflect wavelengths up to an upper cutoff ($\lambda_{50}$) of about 370-450 nm, and more preferably to about 390-420 nm. $\lambda_{50}$ is the wavelength at which the reflectivity of the coating is 50%. Thus, at the upper cutoff of the reflectivity range the reflectivity is 50% and at the lower cutoff, the reflectivity is 50%. If the upper cutoff of the range chosen is too high, a loss of light in the visible range of the spectrum results. If the upper cutoff of the range is chosen too low, then some of the UV is allowed to escape from the arctube. The optimal upper end cutoff ($\lambda_{50}$) was found to be in the range of 390-420 nm (about 405 nm). The lower end cutoff ($\lambda_{50}$) is preferably about 300 nm, or below.

TABLE 1

Spectral Distribution of Lamp Power for a typical QMH lamp

| Wavelength Range (nm) | % of Total Lamp Power |
|---|---|
| 200-250 | 0.6% |
| 250-300 | 1.1% |
| 300-340 | 1.2% |
| 340-370 | 2.3% |
| 370-400 | 3.0% |
| 400-420 | 3.8% |
| 420-440 | 1.3% |
| UV (200-400) | 8.2% |

In one embodiment, the coating is optimized to achieve at least 90% reflectance from 300-370 nm, more preferably at least 95%, most preferably at least 96-98% reflectance from 300-370 nm. The coating is also optimized to achieve high transmittance in the visible region of the spectrum, preferably over 95%, more preferably, at least about 98% for visible wavelengths above about 450 nm.

A high reflectance in the 300-400 nm range ensures that the UV can make multiple bounces inside the arctube, if necessary, before reaching, and being absorbed by the metal halide pool, without substantial absorbance or transmittance by the coating. This maximizes the cumulative UV energy which is returned to and absorbed by the metal halide pool. For example, UV rays which make an average of about six bounces before striking the metal halide pool are still captured with 88% efficiency if the reflectivity is 98%, 74% efficiency if the reflectivity is 95%, but with only 53% efficiency if the reflectivity is 90%. The inventors have determined that for a straight-walled, vertically aligned arctube of the type shown in FIG. 1, an average of 6-7 bounces is typical.

It will be appreciated that the wavelength range between the upper and lower cutoffs may vary depending on the spectral distribution of the selected lamp. The above ranges are selected for the QMH lamp shown in TABLE 1. For example, where there is little or no UV emitted in the 390 to 400 nm range, the upper end cutoff may be lower.

Additionally, the program used to design the coating is preferably weighted to provide the highest reflectivity in those regions of the UV spectrum where the UV emission is greatest. For example, for a QMH lamp with UV emissions at 365, 391, and 405 nm, the program is preferably weighted so that reflectivity is optimized in the regions of these wavelengths, where the spectral power is highest. In this way, the average reflectivity for the entire UV range is optimized. In more complex programs, the weighting given to optimizing reflectivity for any given wavelength band is preferably directly related to the spectral power at that wavelength, i.e., those bands for which the spectral power is higher receive a comparatively higher weighting and thus the program is more likely to generate a higher reflectivity for these regions.

As will be appreciated, coating design programs are not generally capable of optimizing all characteristics of a coating simultaneously. Thus, by applying a weighting factor which is higher for those characteristics which are considered to be of higher importance (such as high reflectivity where spectral power is high), the program applies greater weight to optimization of the characteristics considered by the operator to be of most importance.

The coating 40 is preferably configured to reflect rather than absorb UV light to minimize overheating of the walls and to maximize heating of the metal halide pool. Lamps of the present invention preferably absorb only about 2-3% per bounce, or less, of the UV in the thin film. About 80-90% of the UV generated is absorbed in the metal halide pool and converted to heat. As a result, the lamp has better thermal uniformity, allowing the metal halide pool to run at a higher temperature, thereby providing a higher LPW for an equivalent life.

It should be appreciated that multi-layer coatings may be optimized to provide more than one of the above-described characteristics. For example, a multi-layer coating may be designed to provide both off normal optimization and high reflectivity. It should be appreciated, however that each additional characteristic for which the coating is designed to accommodate tends to result in some loss of optimization of the other characteristics. When the coating is designed to match the optimum incident angle, with high reflectivity over the preferred range of UV wavelengths, the efficacy of a vertically burning, cylindrical arctube is increased by 8-16% relative to an uncoated arctube.

While not intending to limit the scope of the invention, the following examples of coatings for HID metal halide lamps demonstrate how improvements in the emission of such lamps can be achieved.

EXAMPLES

Example 1

Off-Normal Optimization of UV Coatings

Multi-layer coatings optimized for 30 degree angle of incidence $\alpha$ were applied to vertically operated arctubes in HID metal halide lamps (GE's MVR400NBU). The arctubes were formed from undoped quartz and were substantially as shown in FIG. 1. The coatings were formed from alternating layers of $Ta_2O_5$ (high index material) and $SiO_2$ (low index material) on a quartz substrate. The actual peak angle $\theta_P$ of the distribution of UV rays was determined with a ray tracing program to be about 26° and skewed toward higher angles, such that 30° is the preferred (mean) optimization angle $\alpha$. In the case of the MVR400, two thirds of the distribution was found to fall between 0-45°.

The 30° optimized coating had a 96-98% reflectivity between about 300 and 365 nm and began to reduce around 370 nm.

TABLE 2 lists the design of the 30° optimized coatings in terms of layer composition and thickness, starting with layer 1 (closest to the arctube wall).

TABLE 2

Composition of Multilayer coating Optimized at 30°

| LAYER | MATERIAL | THICKNESS in Å |
|---|---|---|
| 1 | H | 150 |
| 2 | L | 667 |
| 3 | H | 354 |
| 4 | L | 561 |
| 5 | H | 374 |
| 6 | L | 676 |
| 7 | H | 315 |
| 8 | L | 635 |
| 9 | H | 373 |
| 10 | L | 615 |
| 11 | H | 289 |
| 12 | L | 745 |
| 13 | H | 294 |
| 14 | L | 515 |
| 15 | H | 228 |
| 16 | L | 100 |
| 17 | H | 100 |
| 18 | L | 1140 |

L = low index material—$Si0_2$
H = high index material—$Ta_2O_5$

Figure 4:
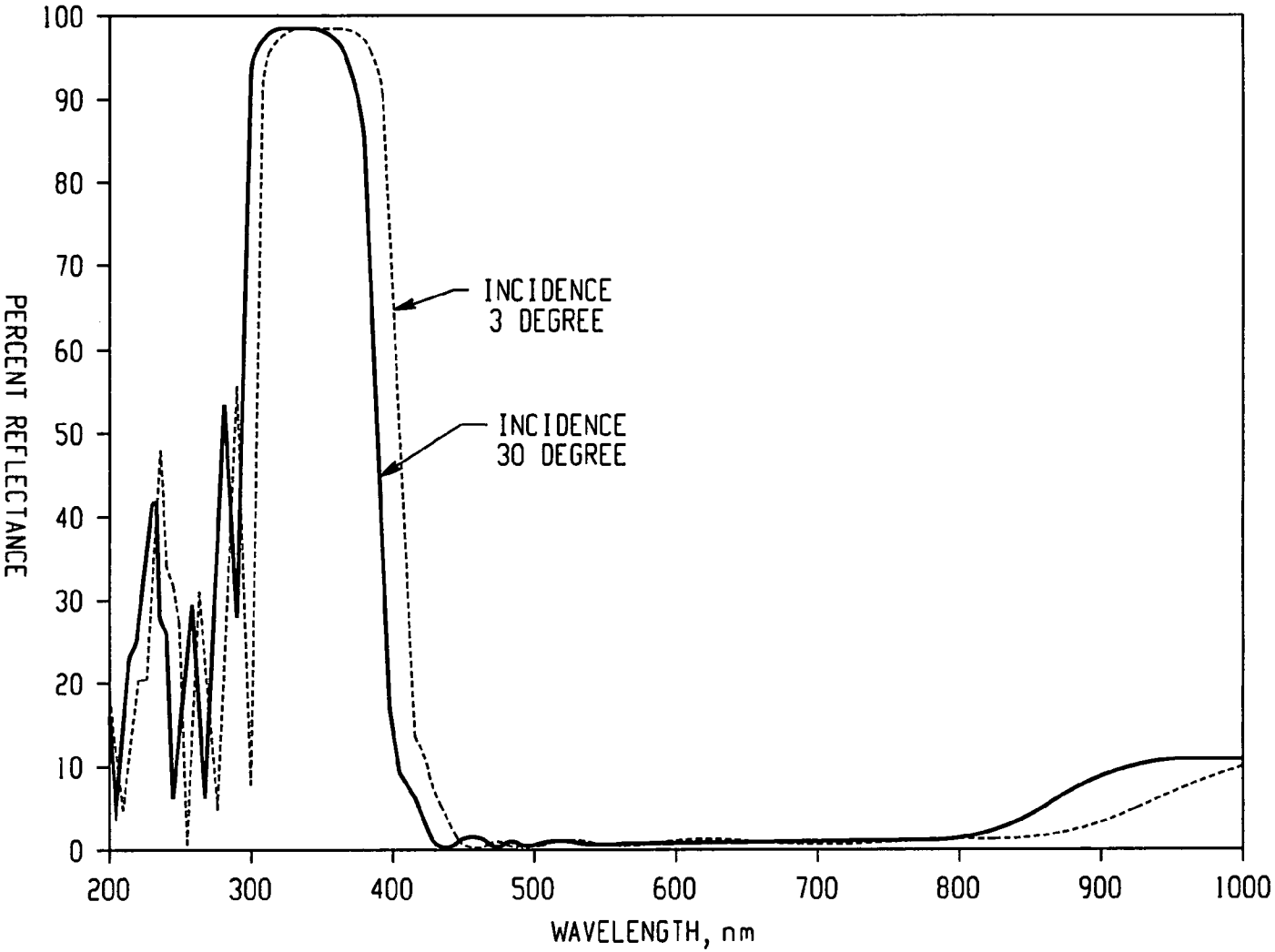
FIG. 4 is a plot of reflectivity versus wavelength for a UV coated lamp normalized at 30° and viewed at 0° and 30° incidence.
Figure 5:
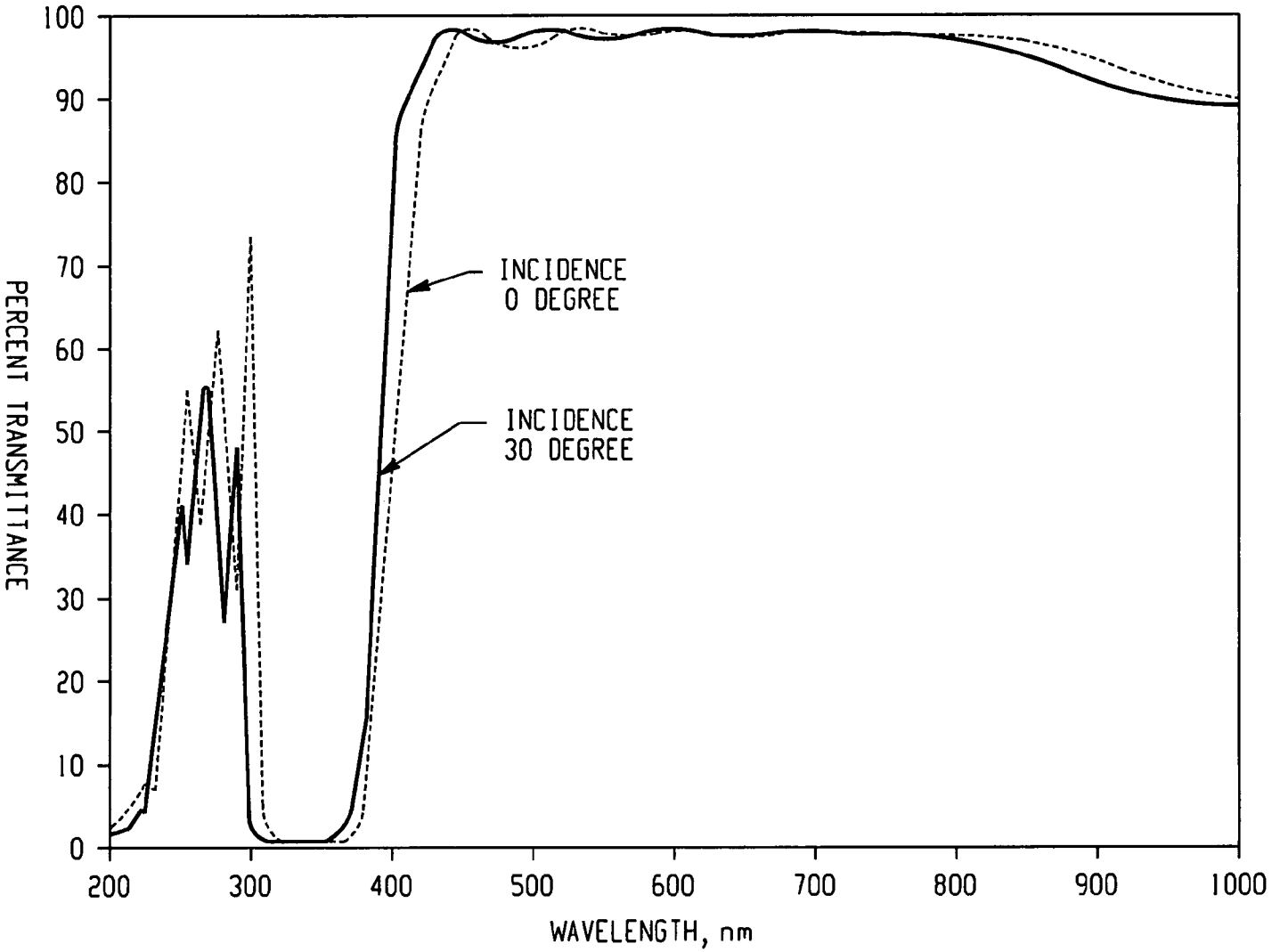
FIG. 5 is a plot of transmission versus wavelength for a UV coated lamp normalized at 30° and viewed at 0° and 30° incidence.

FIGS. 4 and 5 show the reflectance and transmittance of the coating in the range of 200-1000 nm for angles of incidence at 0° and 30°.

As can be seen from FIG. 4, the reflectance plot is shifted downwards in wavelength by about 20 nm, when the coating is viewed at 30° as compared to the coating when viewed at 0°.

Example 2

Calculated Improvement in Performance for 30° Optimized Lamps

The 30 degree optimized, high-reflectivity lamp of Example 1 was compared with other UV-coated lamps. TABLE 3 shows the results of ray tracing calculations of the amount of UV emitted by the arc which is delivered by the coating to the end of the arctube where the metal halide pool is located, as a function of reflectivity and optimization angle. The numbers shown in the table represent the percentage of rays emitted from the arc, in the wavelength range specified, which are ultimately reflected back to the metal halide pool. Thus, for example, in the near UV range (300-400 nm) only 30.8% of the UV rays emitted return to the metal halide pool for a low reflectivity (90%) coated tube optimized at 150 from normal, as compared to 49.9% for an equivalent arctube with a coating which is optimized at the optimization angle $\alpha$=30° and formed for high reflectivity (averaging 98% in the 300-370 nm range). As can be appreciated, the UV which does not return to the pool is essentially wasted, either heating up the arctube walls, or passing through the walls. Optimization at 30° in combination with a high reflectivity (96-98%, for the lamp of Example 1) was calculated to provide a 50% improvement over a similar lamp optimized at about 15° and with lower reflectivity (Low-R) and 15% improvement over a lamp optimized at 15° with high reflectivity (High-R). A 16% increase in LPW was obtained for the 30°, High-R lamp, as compared to an uncoated lamp, whereas the Low-R, 15° optimized coating provided only a 2-5% increase in LPW.

TABLE 3

| | Calculated Reflectance For Thin Films | | | |
|---|---|---|---|---|
| UV Range | Low-R Optimized at 15° | High-R Optimized at 15° | Low-R Optimized at 30° | High-R Optimized at 30° |
| Near UV (300-400 nm) | 30.8 | 40.1 | 45.1 | 49.9 |
| Peak Maximum (365 nm) | 45.4 | 60.0 | 63.7 | 73.1 |
| Peak Area (350-370 nm) | 49.9 | 64.2 | 65.5 | 75.7 |

The Low-R designs in Table 3 average about 90% reflectance over the range 300-370 nm and the High-R designs average 98% over that range.

Lumen maintenance tests were performed on vertically oriented cylindrical lamps (GE's MVR 400) coated with the 30 degree optimized coating 40 of Example 1. The lamps were found to have significantly better lumen maintenance over the 4000 hours of the test than equivalent uncoated lamps.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method of improving the efficacy of a metal halide lamp comprising:

disposing a multilayer coating on a surface of an arctube, the coating comprising layers of at least two materials of different refractive index, which in combination transmit visible radiation and reflect radiation in the UV region of the electromagnetic spectrum, the coating being optimized to reflect at least 95% of UV radiation from 300-370 nm striking the coating, an angle at which the coating is optimized being within about 10° of a mean angle at which UV light strikes the arctube wall;

operating the lamp to cause UV and visible radiation emission from an arc; and reflecting the UV radiation back into the lamp.

2. The method of claim 1, wherein the coating is optimized to reflect at least 98% of UV radiation striking the coating.

3. The method of claim 1, wherein the lamp includes a metal halide pool and the arctube is formed of pure quartz or undoped quartz and is in a vertical orientation, such that at least 45% of the UV emitted by the arc in the wavelength range of 300-400 nm reaches the metal halide pool.

4. The method of claim 1, further comprising determining a region of the lamp where the UV emission is greatest and wherein the coating is optimized by weighting a software program to design the coating so that it has its greatest reflectivity in the region of the UV spectrum where the UV emission from the lamp is greatest.

5. The method of claim 1, further including:

determining a spectral distribution of the lamp when uncoated; and optimizing the coating to provide greater reflectivity in the region of the UV spectrum where the UV emission is greatest.

6. The method of claim 1, further including:

reflecting a portion of the visible light in a wavelength range of from 400-450 nanometers back into the lamp.

7. The method of claim 1, wherein the angle at which the coating is optimized is within about 5° of the mean angle.

8. A metal halide lamp formed by the method of claim 1 comprising:

an envelope;

a metal halide pool within the envelope for generating a discharge when the lamp is operated; and a multi-layer coating on a surface of the envelope, the coating comprising layers of at least two materials of different refractive index, which in combination transmit visible radiation and reflect radiation in the UV region of the electromagnetic spectrum, the multi-layer coating reflecting at least 95% of UV radiation from 300-370 nm striking the coating.

9. The lamp of claim 8, wherein the coating has been optimized for reflection of UV radiation which strikes the envelope at an angle which is within 10° of a mean angle of incidence of the UV radiation on the arctube.

10. A method of improving the efficacy of a metal halide lamp comprising an arctube which in operation emits UV and visible light comprising:

determining a mean angle at which the UV light strikes the arctube;

disposing a multilayer coating on a surface of the arctube, the coating comprising layers of at least two materials of different refractive index, which in combination transmit visible radiation and reflect radiation in the UV region of the electromagnetic spectrum, the multilayer coating being optimized with a computer program which optimizes the coating for a selected angle to the arctube wall, the angle at which the coating is optimized being selected to be within about 10° of the mean angle to take into account off-normal incidence of the radiation on the arctube during operation of the lamp.

11. The method of claim 10, wherein the angle at which the coating is optimized is within about 5° of the mean angle.

12. A method for improving the efficiency of a metal halide lamp comprising:

determining a spectral power distribution for the lamp;

disposing a multilayer coating on a surface of an arctube of the lamp which reflects radiation in the UV region of the electromagnetic spectrum, the coating being optimized by a computer program which selects an optimum number and thickness of layers of the coating for optimizing the coating to reflect UV light at each of a plurality of wavelengths in direct proportion to the spectral power at each of the plurality of wavelengths, the multi-layer coating being optimized at an angle which is within about 10° of a mean angle at which UV light strikes the arctube wall;

operating the lamp to cause UV emission from an arc; and reflecting the UV radiation back into the lamp.

13. The method of claim 12, wherein the coating reflects UV radiation such that at least 45% of the UV emitted by the arc in the wavelength range of 300-400 nm reaches a metal halide pool.

14. A method of improving the efficacy of a metal halide lamp which in operation, has an emission in the UV region of the electromagnetic spectrum, comprising:

disposing a multi-layer coating on a surface of an arctube, the coating comprising layers of at least two materials of different refractive index, which in combination transmit visible radiation and reflect radiation in the UV region of the electromagnetic spectrum, the multi-layer coating being optimized by a computer program at an angle which is selected to take into account off-normal incidence of the radiation on the arctube during operation of the lamp, the angle at which the coating is optimized being within about 10° of a mean angle at which UV light strikes the arctube wall.

15. The method of claim 14 wherein the method further includes:

determining a mean angle at which UV light within the arctube is incident on the arctube.

16. The method of claim 14, wherein the angle at which the coating is optimized is less than 35° from a direction normal to the arctube surface.

17. The method of claim 16, wherein angle at which the coating is optimized is from 10° to 35° from a direction normal to the arctube surface.

18. The method of claim 17, wherein the arctube is vertically aligned and the angle at which the coating is optimized is from about 15° to about 30° from a direction normal to the arctube surface.

19. The method of claim 18, wherein the aretube is generally cylindrical in shape and the angle at which the coating is optimized is between about 20° and about 30° from a direction normal to the arctube surface.

20. The method of claim 14, wherein the angle at which the coating is optimized is within 5° of the mean angle.

21. The method of claim 14 wherein the step of disposing a multi-layer coating on a surface of an arctube includes:

utilizing a computer program for calculating a thickness of each of the layers and an optimum number of layers in the coating to optimize the coating at the angle.

22. The method of claim 14, wherein the step of optimization of the coating includes applying a greater weighting to providing high reflectivity in regions of the UV spectrum where spectral power is high.

23. The method of claim 14, wherein the coating is optimized to reflect an average of at least 90% of the UV emission of the lamp between 300 and 391 nm.

24. The method of claim 23, wherein the coating is optimized to reflect an average of at least 95% of the UV emission of the lamp between 300 and 370 nm.

* * * * *